US009322312B2

(12) United States Patent
Catalogna et al.

(10) Patent No.: US 9,322,312 B2
(45) Date of Patent: Apr. 26, 2016

(54) AMBIENT HUMIDITY AND TEMPERATURE CORRECTION TO PARTICULATE FILTER SOOT RATE

(71) Applicant: GM GLOBAL TECHNOLOGY OPERATIONS LLC, Detroit, MI (US)

(72) Inventors: John A. Catalogna, Commerce Township, MI (US); Rebecca J. Darr, Milford, MI (US); Rahul Mital, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 28 days.

(21) Appl. No.: 14/197,856

(22) Filed: Mar. 5, 2014

(65) Prior Publication Data

US 2015/0252699 A1 Sep. 10, 2015

(51) Int. Cl.

| | |
|---|---|
| ***F01N 3/00*** | (2006.01) |
| ***F01N 3/023*** | (2006.01) |
| ***F02D 41/02*** | (2006.01) |
| *F01N 9/00* | (2006.01) |

(52) U.S. Cl.

CPC ..... *F01N 3/023* (2013.01); *F02D 41/029* (2013.01); *F01N 9/002* (2013.01); *F01N 9/005* (2013.01); *F01N 2560/028* (2013.01); *F01N 2900/08* (2013.01); *F01N 2900/1404* (2013.01); *F01N 2900/1606* (2013.01); *F01N 2900/1628* (2013.01); *F02D 2200/0418* (2013.01); *F02D 2200/0812* (2013.01)

(58) Field of Classification Search

CPC ..... F02D 41/029; F01N 9/002; F01N 3/0842; F01N 3/035; F01N 13/02

USPC ..... 60/273, 274, 285, 286, 297, 295

See application file for complete search history.

(56) References Cited

U.S. PATENT DOCUMENTS

| | | | | |
|---|---|---|---|---|
| 4,462,208 | A | 7/1984 | Hicks et al. | |
| 8,479,495 | B2 | 7/2013 | Funk et al. | |
| 2002/0078681 | A1 * | 6/2002 | Carberry et al. | 60/280 |
| 2003/0200746 | A1 * | 10/2003 | Saito et al. | 60/295 |
| 2004/0226287 | A1 * | 11/2004 | Edgar et al. | 60/295 |
| 2009/0188241 | A1 * | 7/2009 | Sugiarto et al. | 60/295 |
| 2009/0188242 | A1 * | 7/2009 | Williams et al. | 60/295 |
| 2009/0188243 | A1 * | 7/2009 | Williams et al. | 60/295 |
| 2009/0199544 | A1 * | 8/2009 | Etcheverry et al. | 60/294 |
| 2010/0101409 | A1 * | 4/2010 | Bromberg et al. | 95/8 |
| 2011/0262329 | A1 * | 10/2011 | Ofoli et al. | 423/213.2 |
| 2012/0285141 | A1 * | 11/2012 | Brown et al. | 60/274 |
| 2013/0145822 | A1 * | 6/2013 | Karlsson et al. | 73/23.31 |
| 2014/0000239 | A1 | 1/2014 | Swoish et al. | |

* cited by examiner

*Primary Examiner* — Patrick Maines
(74) *Attorney, Agent, or Firm* — Cantor Colburn LLP

(57) ABSTRACT

In one exemplary embodiment of the invention, a method of regenerating an exhaust gas particulate filter in a vehicle having an internal combustion engine is provided. The method includes determining a soot accumulation in the particulate filter, determining a soot humidity and temperature correction factor, and adjusting, using the soot humidity and temperature correction factor, the soot accumulation to determine a corrected soot accumulation in the particulate filter. The method further includes performing a regeneration of the particulate filter when at least one of the following occurs: the corrected soot accumulation reaches a predetermined threshold, and the corrected soot accumulation indicates a contorted soot mass to flow resistance relationship.

19 Claims, 3 Drawing Sheets

AMBIENT HUMIDITY AND TEMPERATURE CORRECTION TO PARTICULATE FILTER SOOT RATE

FIELD OF THE INVENTION

The subject invention relates to control systems for internal combustion engines, and more particularly to particulate filter regeneration systems.

BACKGROUND

A combustion cycle of an engine produces particulates that are typically filtered from exhaust gas by a particulate filter (PF). The PF is arranged in an exhaust system of the engine and filters particulates (e.g., soot) from exhaust gas flowing through the exhaust system. Over time, soot and other particulates accumulate in the PF, which may restrict flow through the PF. Accordingly, a regeneration process may be implemented to reduce soot levels within the PF. For example, the regeneration process may include igniting soot particles within the PF.

Some known vehicles detect soot accumulation in the PF and initiate the regeneration process when the accumulation reaches a predetermined threshold. However, some vehicles may not accurately detect soot accumulation when the vehicle is operated in atypical environmental conditions, which may affect the regeneration process or operation of the exhaust system. For example, increased soot production has been observed when the ambient humidity and/or temperature is increased resulting in faster soot accumulation rates in the PF.

Accordingly, it is desirable to provide a system and method for detecting and predicting the impact of ambient humidity and temperature on soot production and detection.

SUMMARY OF THE INVENTION

In one exemplary embodiment of the invention, a method of regenerating an exhaust gas particulate filter in a vehicle having an internal combustion engine is provided. The method includes determining a soot accumulation in the particulate filter, determining a soot humidity and temperature correction factor, and adjusting, using the soot humidity and temperature correction factor, the soot accumulation to determine a corrected soot accumulation in the particulate filter. The method further includes performing a regeneration of the particulate filter when at least one of the following occurs: the corrected soot accumulation reaches a predetermined threshold, and the corrected soot accumulation indicates a contorted soot mass to flow resistance relationship.

In another exemplary embodiment of the invention, a regeneration system for an exhaust gas particulate filter for a vehicle having an internal combustion engine is provided. The regeneration system includes a soot accumulation module programmed to determine a soot accumulation in the particulate filter, a soot humidity and temperature correction factor module programmed to determine a soot humidity and temperature correction factor, and a corrected soot accumulation module programmed to adjust, using the soot humidity and temperature correction factor, the soot accumulation to determine a corrected soot accumulation in the particulate filter. The system also includes a regeneration control module programmed to perform a regeneration of the particulate filter when at least one of the following occurs: the corrected soot accumulation reaches a predetermined threshold, and the corrected soot accumulation indicates a contorted soot mass flow resistance relationship.

In yet another exemplary embodiment of the invention, a method of adjusting a regeneration process of an exhaust gas particulate filter to account for various ambient humidity conditions is provided. The method includes determining a soot mass in the particulate filter, determining an ambient humidity, and adjusting a duration of a regeneration process of the particulate filter to account for an impact of the ambient humidity on soot production and soot accumulation in the particulate filter.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
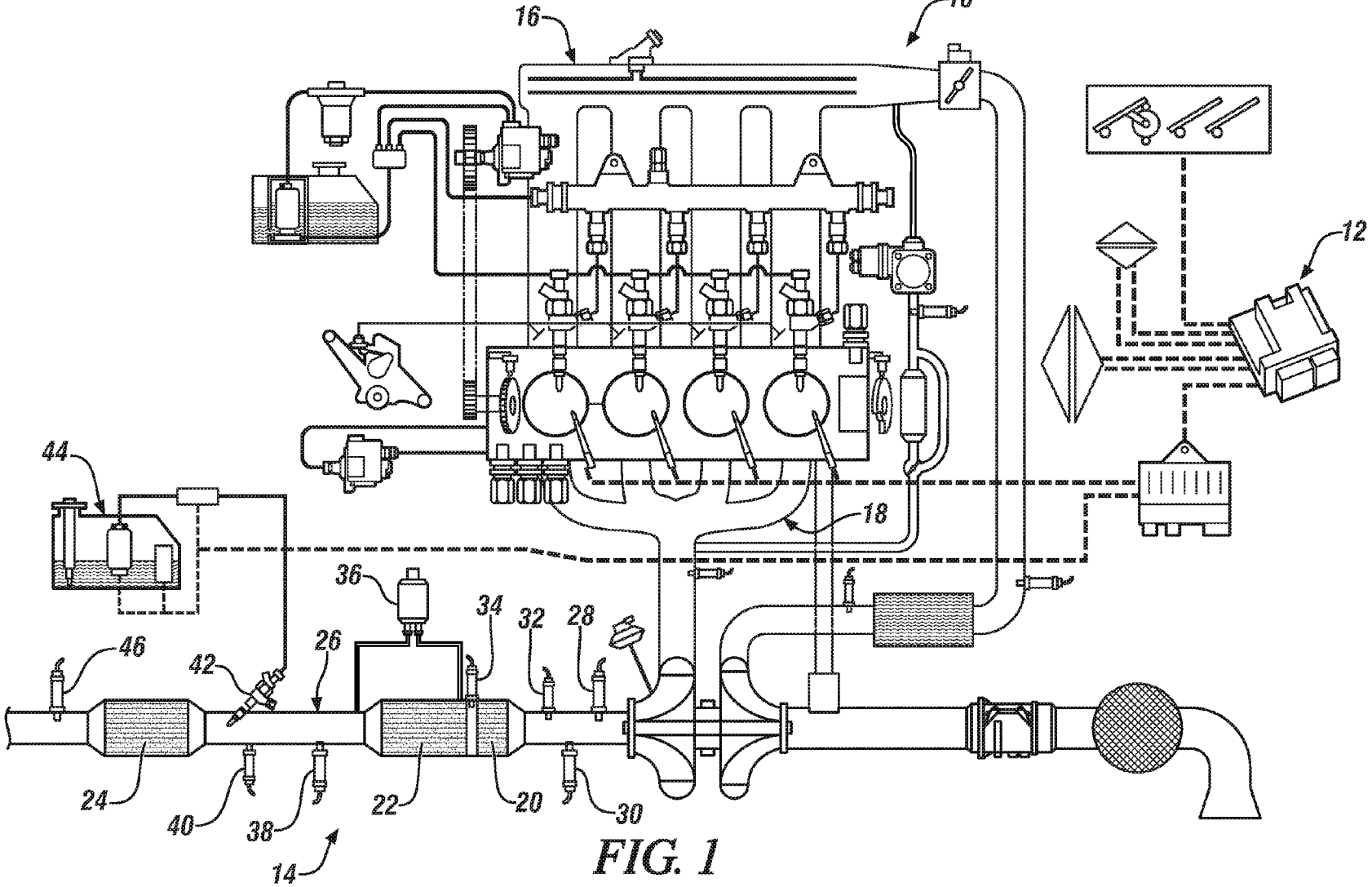
FIG. 1 is an illustration of an exemplary internal combustion engine, controller, and exhaust aftertreatment system.

The following description is merely exemplary in nature and is not intended to limit the present disclosure, its application or uses. It should be understood that throughout the drawings, corresponding reference numerals indicate like or corresponding parts and features.

Control module, module, control, controller, control, unit, processor, and similar terms mean any suitable one or various combination of one or more of Application Specific Integrated Circuit(s) (ASIC), electronic circuits, central processing units (e.g., microprocessors) and associated memory and storage (e.g., read only, programmable read only, random access, hard drive, etc.) executing one or more software or firmware programs or routines, combinational logic circuits, input/output circuits and devices, appropriate signal conditioning and buffer circuitry, and other suitable components to provide the described functionality. Software, firmware, programs, instructions, routines, code, models, and algorithms and similar terms mean any controller executable instruction sets including calibrations and look-up tables.

In accordance with an exemplary embodiment of the invention, FIG. 1 illustrates an exemplary internal combustion engine 10, a controller 12, and an exhaust aftertreatment system 14. Engine 10 includes an intake manifold 16 and an exhaust manifold 18. Exhaust aftertreatment system 14 is coupled to exhaust manifold 18 and may include an oxidation catalyst (OC) 20 located upstream of a particulate filter (PF) 22, such as a diesel particulate filter, and a selective catalytic reduction (SCR) catalyst 24 along an exhaust gas conduit 26. System 14 also includes a lambda sensor 28, a NOx sensor 30, a temperature sensor 32, a PF temperature sensor 34, a PF relative pressure sensor 36, a particulate matter sensor 38, a temperature sensor 40, a urea injector 42 fluidly coupled to a urea storage tank 44, and an NOx sensor 46. However, exhaust aftertreatment system 14 may include additional or less components and sensors.

Engine 10 includes sensors (not shown) to monitor engine operation and actuators (not shown) which control engine operation. The sensors and actuators are signally and operatively connected to controller 12. Controller 12 executes routines stored therein to control the actuators to control engine operation, including throttle position, fuel injection mass and timing, EGR valve position to control flow of recirculated exhaust gases, compressor boost, glow-plug operation, and control of intake and/or exhaust valve timing, phasing, and lift on systems so equipped.

Figure 2:
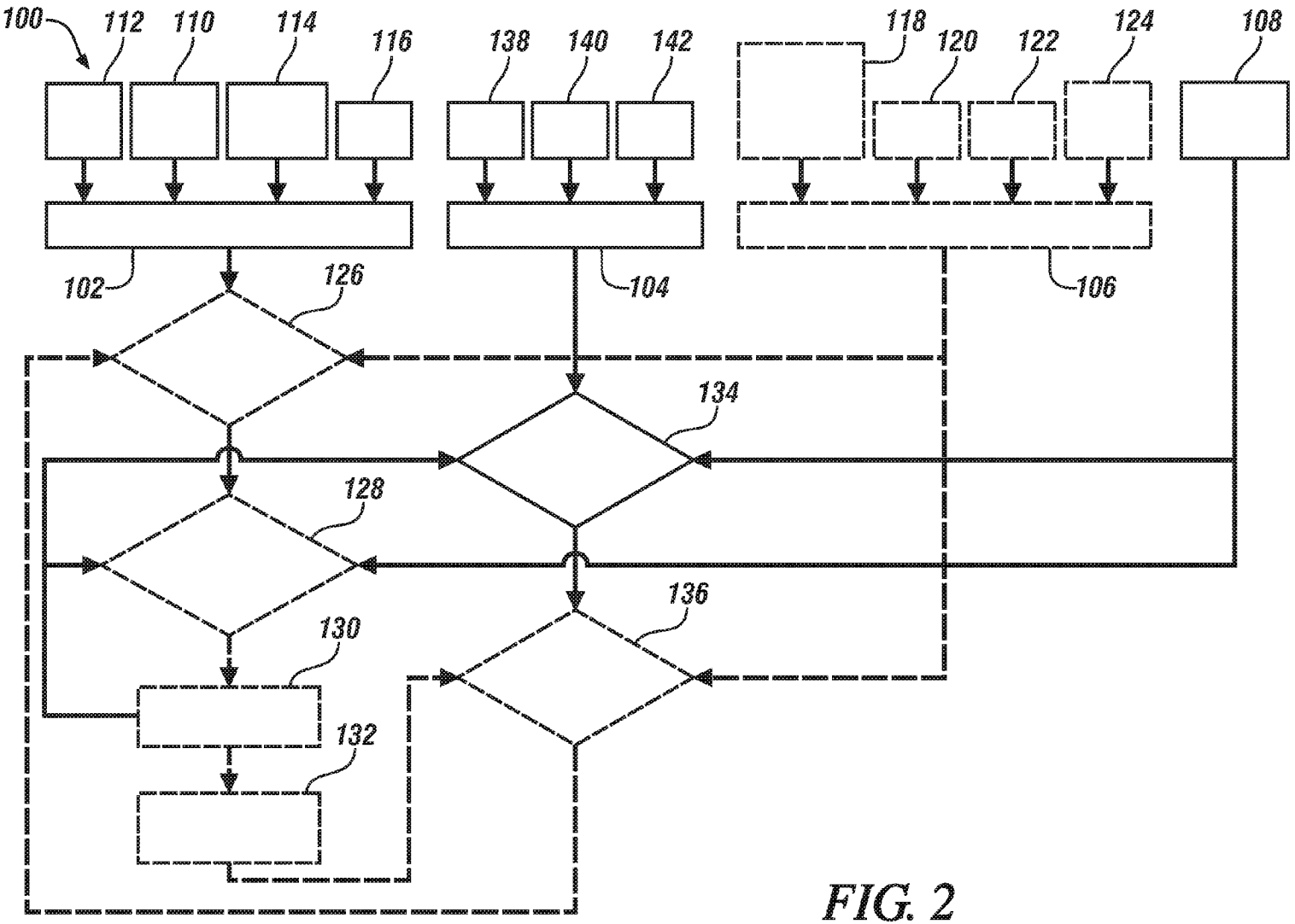
FIG. 2 is an exemplary control scheme that controls a regeneration process for the exhaust aftertreatment system.

FIG. 2 schematically illustrates a control scheme 100 for controlling and adjusting a regeneration of PF 22. Control scheme 100 includes predicting and/or determining the impact of environmental conditions (e.g., ambient humidity and/or temperature) on soot production in engine 10 and soot accumulation in PF 22, adjusting the regeneration operation of PF 22 based on the environmental conditions, and learning and adapting the control scheme to better predict soot accumulation to improve regeneration operation efficiency. Control scheme 100 may be periodically executed during ongoing engine operation, with soot production/accumulation modeled or determined over time with an ambient humidity and temperature soot correction. Regeneration of PF 22 may be controlled in response to predicted soot mass flow rate production in engine 10 and/or soot mass in PF 22.

In the exemplary embodiment, control scheme 100 generally includes a soot accumulation module 102, a soot mass flow rate module 104, a soot humidity and temperature correction factor module 106, and an engine operating mode module 108. Modules 102, 104, 106, and 108 may be part of or communicatively coupled with controller 12.

Soot accumulation module 102 for resistance flow soot accumulation modeling is programmed to monitor one or more measured and/or estimated characteristics of engine system 10, 14 to determine soot accumulation. For example, soot accumulation module 102 includes a model programmed to determine a soot mass in particulate filter 22. In the exemplary embodiment, soot accumulation module 102 determines soot mass based upon the pressure difference reading 110 in PF 22 measured by PF Δpressure sensor 36. Module 102 may also determine soot mass based upon factors such as an engine off time 112, a mileage since the last particulate filter regeneration 114, and an exhaust gas volume flow 116.

Typically, once the Δpressure or predicted soot mass in PF 22 reaches a predetermined threshold, controller 12 triggers a regeneration of PF 22. However, it has been observed that environmental conditions can affect soot production. For example, in high humidity conditions, the air/fuel ratio may shift in engine 10 causing a rich combustion that may result in an increased engine-out soot production and faster soot accumulation rates in PF 22. This may lead to a contorted soot mass to flow resistance relationship. For example, with an increase in humidity at the same combustion air mass and fueling, soot mass production may change due to the oxygen percentage in that volume of air being reduced by water concentration, thereby resulting in a change in charge/combustion density. So, at the same exhaust volume flow across the PF, the same engine out temperature, and with an elevated water content in the combustion volume, the soot mass may have increased causing a contorted soot mass to flow resistance relationship. Without appropriate humidity/temperature detection and correction, a system may not accurately determine the soot mass in the particulate filter, which may cause overloading of the particulate filter and/or cause vehicle power loss before a regeneration is initiated. Accordingly, a soot humidity and temperature correction factor is used to account for ambient humidity and temperature.

Soot humidity and temperature correction factor module 106 is programmed to determine the soot humidity and temperature correction factor based upon a humidity model 118 based on temperature, air mass (i.e., respective mass of air going into the cylinder), and $O_2$% (i.e., percent based oxygen level in the air), a measured humidity 120 (e.g., from a humidity sensor located in an air box or upstream of intake manifold 16), a measured barometric pressure 122 as a function of ambient humidity and temperature, and/or an air/fuel stoichiometric ratio 124 as a function of ambient humidity and temperature (e.g., modeled from NOx sensors 30, 46 and lambda sensor 28). The soot humidity and temperature correction factor facilitates correction of the modeled soot accumulation in PF 22.

In the exemplary embodiment, control scheme 100 also includes a corrected soot accumulation module 126, a regeneration control module 128, a remaining soot level module 130, and an adjusted rate based soot production module 132. Modules 126, 128, 130, and 132 may be part of or communicatively coupled with controller 12.

Corrected soot accumulation module 126 is programmed to determine a corrected soot accumulation in PF 22 based on the soot accumulation from module 102 and the soot humidity and temperature correction factor from module 106. Accordingly, the soot humidity and temperature correction factor is used to adjust the determined soot accumulation to account for current humidity and temperature conditions. In addition, module 126 may determine the corrected soot accumulation based on a corrected simulated soot mass flow rate from the engine, as described herein in more detail.

Regeneration control module 128 for opportunistic PF regeneration based on soot mass is programmed to initiate PF regeneration if the corrected soot accumulation reaches or exceeds a predetermined threshold and/or if conditions exist that could result in contorted soot mass to flow resistance relationship. Based on the corrected soot accumulation, module 128 may initiate regeneration at a time and duration different from the time and duration of a regeneration during normal or typical environmental conditions. For example, if the corrected soot accumulation indicates increased soot accumulation due to high ambient humidity conditions, module 128 may initiate a regeneration earlier than it would during normal humidity conditions.

Further, high ambient humidity conditions may cause increased soot production and resulting increased soot accumulation in PF 22 (i.e., an actual overloaded PF condition, but which may be an under-predicted soot mass by some known systems). Accordingly, at the predetermined threshold, the corrected soot accumulation triggers regeneration control module 128 to initiate an extended regeneration that has a duration longer than a regeneration that would take place during nominal vehicle operation conditions. This ensures the integrity of the burn efficiency during overloaded soot mass levels in PF 22 such that a desired amount of the soot is burned off.

Similarly, low ambient humidity conditions may cause decreased soot production and resulting decreased soot accumulation in PF 22 (i.e., an underloaded PF condition, but which may be an over-predicted soot mass by some known systems). Accordingly, at the predetermined threshold, the corrected soot accumulation triggers regeneration control module 128 to initiate a shortened regeneration that has a duration shorter than a regeneration that would take place during nominal vehicle operation conditions. This also ensures the integrity of the burn efficiency during underloaded soot mass levels in PF 22. In addition to extended and shortened regenerations, module 128 may also determine when to initiate regeneration based on signals from engine operating mode module 108 (e.g., soot accumulation signal, soot burning signal, long-term ash storing signal).

Remaining soot level module 130 for remaining soot level plausibility is programmed to periodically determine a remaining soot level in PF 22 during regeneration. Module 130 determines the remaining soot level based on the measured resistance flow across PF 22 using PF Δpressure sensor 36. Module 130 and/or module 128 may then determine a length of time to continue the regeneration to meet a desired burn efficiency (e.g., 95% soot burn-off). The remaining soot level in PF 22 may also be used to determine a simulated soot mass flow rate, as described herein in more detail.

Once the regeneration is terminated (e.g., reverts to a normal operation mode), adjusted rate based soot production module 132 is programmed to compare a set of conditions and inputs during this regeneration to a set of conditions/inputs during a previous regeneration(s) (e.g., the last five regenerations). For example, module 132 compares a time duration of the terminated regeneration at a first set of conditions (e.g., temperature, humidity, etc.) that occurred during that regeneration with a time duration of the previous regeneration(s) at a second set of conditions (e.g., temperature, humidity, etc.). Based on the time duration and condition/input comparisons between various regenerations, module 132 is programmed to adjust or adapt the model for predicting soot mass flow rate in engine 10 (i.e., module 132 determines an adjusted rate based soot production). As such, module 132 uses what was learned from the previous regenerations and applies the remaining soot level after the regeneration is complete to a corrected simulated soot module 136, which may be the starting point for module 126, as described herein in more detail. The addition or reduction of regeneration time may be back calculated to a soot mass which is then added to a simulated soot value in module 136 and/or module 126.

In the exemplary embodiment, control scheme 100 also includes a simulated soot module 134 and corrected simulated soot module 136. Modules 134 and 136 may be part of or communicatively coupled with controller 12.

Soot mass flow rate module 104 (e.g., of ash) is programmed to model the soot mass flow rate of engine 10 and to provide corrections based on vehicle speed 138, engine speed 140, and/or fueling point. Simulated soot module 134 is programmed to model and/or determine a simulated soot mass flow rate in engine 10 based at least in part on the soot mass flow rate from module 104. Module 134 may also determine the simulated soot mass flow rate based on data from engine operating mode module 108 and the remaining soot level in PF 22 from remaining soot level module 130.

Corrected simulated soot module 136 is programmed to determine a corrected simulated soot mass flow rate from engine 10 based on the simulated soot mass from module 134, the soot humidity and temperature correction factor from module 106, and the adjusted rate based soot production from module 132. Accordingly, corrected soot accumulation module 126 may further determine the corrected soot accumulation based on the corrected simulated soot mass flow rate from module 136. This enables control scheme 100 to constantly learn and adapt to various environmental conditions to thus provide the most efficient regeneration initiation and duration during such conditions.

Figure 3:
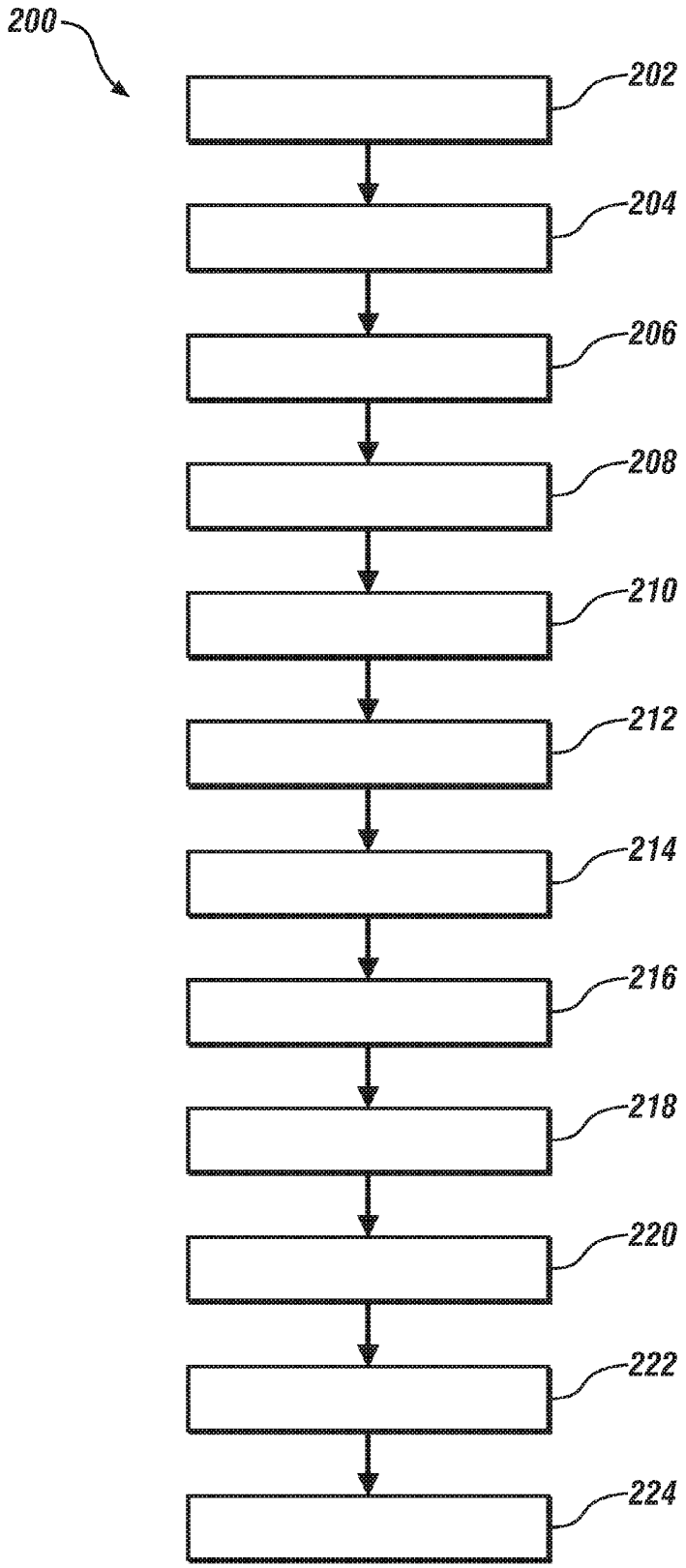
FIG. 3 is a flow diagram of an exemplary method of regenerating a particulate filter of the exhaust aftertreatment system.

As illustrated in FIG. 3, an exemplary method of regenerating PF 22 is generally indicated by reference numeral 200. Method 200 includes: At step 202, determining the soot accumulation in PF 22. At step 204, determining the soot humidity and temperature correction factor. At step 206, adjusting the soot accumulation to determine the corrected soot accumulation in PF 22, which is determined with the soot humidity and temperature correction factor. At step 208, performing a regeneration of PF 22 when the corrected soot accumulation reaches a predetermined threshold and/or the corrected soot accumulation indicates a contorted soot mass to flow resistance relationship. The regeneration may be the extended regeneration or the shortened regeneration depending on the ambient humidity and temperature.

Method 200 further includes, at step 210, determining the remaining soot level in PF 22 by determining the flow resistance in PF 22 during the regeneration thereof. At step 212, determining a length of time to continue the regeneration based on the remaining soot level in PF 22. At step 214, terminating the regeneration of PF 22. At step 216, subsequently comparing measured conditions (e.g., duration, humidity, temperature, etc.) of the regeneration to measured conditions during a previous regeneration, and determining an adjusted rate based soot production based on the comparison between the conditions during the regeneration and the conditions during the previous regeneration.

In the exemplary embodiment, at step 218, determining the soot mass flow rate of engine 10 based on at least one of vehicle speed, engine speed, and fuel. At step 220, determining a simulated soot mass flow rate in engine 10 based on the soot mass flow rate and at least one of the engine operating mode and the remaining soot level in PF 22. At step 222, determining the corrected simulated soot mass in PF 22 based on at least one of the simulated soot mass flow rate, the soot humidity and temperature correction factor, and the adjusted rate based soot production. At step 224, further determining the corrected soot accumulation based on the corrected simulated soot mass in PF 22.

Described herein are methods and devices for preventing or mitigating vehicle power limiting conditions caused by accumulated soot in a vehicle exhaust system particulate filter. A controller detects humidity and temperature conditions and adjusts the timing and duration of a regeneration process of the particulate filter, thereby facilitating a high particulate burn efficiency in the particulate filter at the given environmental conditions. Additionally, the controller may use data from multiple regenerations to adjust and adapt the system to more accurately determine soot accumulation within the particulate filter during various environmental conditions to increase regeneration and vehicle operation efficiency.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A method of regenerating an exhaust gas particulate filter in a vehicle having an internal combustion engine, the method comprising:

operating the internal combustion engine;

collecting soot from the internal combustion engine in the particulate filter;

determining a soot accumulation in the particulate filter;

determining a soot humidity and temperature correction factor;

adjusting, using the soot humidity and temperature correction factor, the soot accumulation to determine a corrected soot accumulation in the particulate filter;

activating a regeneration system to regenerate the particulate filter when at least one of the following occurs:

the corrected soot accumulation reaches a predetermined threshold; and the corrected soot accumulation accounts for a soot mass to flow resistance relationship distorted by temperature and humidity conditions;

initiating a regeneration of the particulate filter; and regenerating the particulate filter.

2. The method of claim 1, wherein the soot accumulation is determined by a predictive model based on a measured flow resistance in the particulate filter.

3. The method of claim 1, wherein the soot humidity and temperature correction factor is determined based on at least one of a humidity model based on temperature, air mass, and $0_2$%, a humidity measurement from a humidity sensor, an air/fuel stoichiometric ratio as a function of ambient humidity and temperature, and a barometric pressure as a function of ambient humidity and temperature.

4. The method of claim 1, wherein the step of regenerating the particulate filter comprises:

performing an extended regeneration for a time duration longer than a regeneration during nominal vehicle operation conditions when the soot humidity and temperature correction factor indicates an overloaded soot condition in the particulate filter due to environmental conditions; and performing a shortened regeneration for a time duration shorter than the regeneration during nominal vehicle operation conditions when the soot humidity and temperature correction factor indicates an underloaded soot condition in the particulate filter due to environmental conditions.

5. The method of claim 1, further comprising determining a flow resistance in the particulate filter during regeneration of the particulate filter to determine a remaining soot level in the particulate filter; and determining, based on the remaining soot level, a length of time to continue the regeneration.

6. The method of claim 1, further comprising:

terminating regeneration of the particulate filter;

performing a comparison, after termination of the regeneration, conditions during the regeneration to conditions during a previous regeneration of the particulate filter; and determining an adjusted rate based soot production based on the comparison of the conditions during the regeneration and the conditions during the previous regeneration.

7. The method of claim 6, wherein the step of comparing the conditions during regeneration of the particulate filter and the conditions during the previous regeneration comprises:

comparing a time duration of the regeneration and at least one of a measured temperature and humidity during the regeneration with a time duration of the previous regeneration and at least one of a measured temperature and humidity during the previous regeneration.

8. The method of claim 5, further comprising determining a soot mass flow rate in the exhaust gas from the internal combustion engine based on at least one of a vehicle speed, an engine speed, and a fueling point.

9. The method of claim 8, further comprising determining a simulated soot mass in the particulate filter based on the determined soot mass flow rate and at least one of an engine operating mode and the remaining soot level in the particulate filter.

10. The method of claim 9, further comprising:

terminating regeneration of the particulate filter;

performing a comparison, after termination of the regeneration, of conditions during the regeneration and conditions during a previous regeneration of the particulate filter;

adjusting the corrected soot accumulation based on the comparison between the conditions during the regeneration and the conditions during the previous regeneration, to determine an adjusted rate based soot production;

determining a corrected simulated soot mass flow rate in the internal combustion engine based on at least one of the simulated soot mass flow rate, the soot humidity and temperature correction factor, and adjusted rate based soot production.

11. The method of claim 10, wherein the step of adjusting the soot accumulation to determine a corrected soot accumulation in the particulate filter is further based on the corrected simulated soot mass flow rate.

12. An internal combustion engine system comprising:

an exhaust system having at least an exhaust gas particulate filter; and a regeneration system configured and disposed to control regeneration of the exhaust gas particulate filter, the regeneration system comprising:

a soot accumulation module operably coupled to the particulate filter, the soot accumulation module being configured and disposed to determine a soot accumulation in the particulate filter;

a soot humidity and temperature correction factor module programmed to determine a soot humidity and temperature correction factor;

a corrected soot accumulation module programmed to adjust, using the soot humidity and temperature correction factor, the soot accumulation to determine a corrected soot accumulation in the particulate filter; and a regeneration control module programmed to perform a regeneration of the particulate filter when at least one of the following occurs:

the corrected soot accumulation reaches a predetermined threshold; and the corrected soot accumulation accounts for a soot mass flow resistance relationship distorted by temperature and humidity conditions.

13. The regeneration system of claim 12, wherein the soot accumulation module includes a predictive model based on a measured flow resistance in the particulate filter.

14. The regeneration system of claim 12, wherein the soot humidity and temperature correction factor module is programmed to determine the soot humidity and temperature correction factor based on at least one of a humidity model based on temperature, air mass, and $0_2$%, a humidity measurement from a humidity sensor, an air/fuel stoichiometric ratio and a barometric pressure as a function of ambient humidity and temperature.

15. The regeneration system of claim 12, wherein the regeneration control module is programmed to:

perform an extended regeneration for a time duration longer than a regeneration during nominal vehicle operation conditions when the soot humidity and temperature correction factor indicates an overloaded soot condition in the particulate filter due to environmental conditions; and perform a shortened regeneration for a time duration shorter than the regeneration during nominal vehicle operation conditions when the soot humidity and temperature correction factor indicates an underloaded soot condition in the particulate filter due to environmental conditions.

16. The regeneration system of claim 12, further comprising a remaining soot level module programmed to determine a flow resistance in the particulate filter during the regeneration of the particulate filter to determine a remaining soot level in the particulate filter, and to determine, based on the flow resistance, a length of time to continue the regeneration.

17. The regeneration system of claim 12, further comprising an adjusted rate based soot production module programmed to:

perform a comparison, after a termination of the regeneration, of conditions during the regeneration and conditions during a previous regeneration of the particulate filter; and determine an adjusted rate based soot production based on the comparison of the conditions during the regeneration and the conditions during the previous regeneration.

18. The regeneration system of claim 16, further comprising a soot mass flow rate module programmed to determine a soot mass flow rate in exhaust gas from the internal combustion engine based on at least one of a vehicle speed, an engine speed, and fuel.

19. The regeneration system of claim 18, further comprising:

a simulated soot mass module programmed to determine a simulated soot mass flow rate in the engine based on the determined soot mass flow rate and at least one of an engine operating mode and the remaining soot level in the particulate filter;

an adjusted rate based soot production module programmed to compare, after a termination of the regeneration, conditions during the regeneration to condition during a previous regeneration of the particulate filter to determine an adjusted rate based soot production; and a corrected simulated soot module programmed to determine a corrected simulated soot mass flow rate in the internal combustion engine based on at least one of the simulated soot mass flow rate, the soot humidity and temperature correction factor, and the adjusted rate based soot production.

* * * * *